US005479843A

United States Patent [19]

Yanagisawa

[11] Patent Number: 5,479,843

[45] Date of Patent: Jan. 2, 1996

[54] SPIN-LOCK MUSICAL INSTRUMENT STAND

[75] Inventor: Misuo Yanagisawa, Yachio, Japan

[73] Assignee: Pearl Musical Instrument Co., Chiba, Japan

[21] Appl. No.: 279,245

[22] Filed: Jul. 19, 1994

[51] Int. Cl.[6] ..... G10D 13/08

[52] U.S. Cl. ..... 84/403; 248/187.1

[58] Field of Search ..... 84/387 A, 421, 84/403; 248/177, 187

[56] References Cited

U.S. PATENT DOCUMENTS

| | | | |
|---|---|---|---|
| 3,535,976 | 10/1970 | Osuga | 84/421 |
| 4,158,981 | 6/1979 | Kurosaki | 84/421 |
| 4,216,695 | 8/1980 | Hoshino | 84/421 |
| 4,365,535 | 12/1982 | Buttner et al. | 84/421 |
| 4,526,083 | 7/1985 | LeMert | 84/421 |
| 4,527,760 | 7/1985 | Salacuse | 248/108 |
| 4,543,446 | 9/1985 | Foss et al. | 174/11 R |
| 4,593,596 | 6/1986 | Gauger | 84/421 |
| 4,796,508 | 1/1989 | Hoshino | 84/421 |
| 4,857,674 | 8/1989 | Filbert | 174/135 |
| 4,889,028 | 12/1989 | Lombardi | 84/421 |
| 4,960,028 | 10/1990 | Ramirez | 84/421 |
| 5,120,016 | 6/1992 | Dysarz | 248/539 |
| 5,188,324 | 2/1993 | Joseph et al. | 248/222.3 |
| 5,395,178 | 3/1995 | Chvojesek | 248/177 X |

*Primary Examiner*—Patrick J. Stanzione
*Attorney, Agent, or Firm*—Longacre & White

[57] ABSTRACT

A support fixture for musical instruments, and more particularly, an improved support mechanism is provided incorporating a spin-lock type mechanism which permits quick and easy assembly while providing a sturdy and durable arrangement. The assembly mechanism of the invention is particularly suited for musical instruments stands to be used by small children.

15 Claims, 6 Drawing Sheets

SPIN-LOCK MUSICAL INSTRUMENT STAND

BACKGROUND OF THE INVENTION

1. Field of the Invention

This invention relates to a support fixture for musical instruments. More particularly, the invention relates to an improved support mechanism incorporating a spin-lock type mechanism which permits easy assembly while providing a sturdy and durable arrangement.

2. Description of Related Art

Particularly for instrument stands used by school aged children, musical instrument equipment must be simple in form, easy to assembly, and must hold the instrument firmly in place. Instruments are assembled and disassembled several times weekly (sometimes several times daily), thus the instrument stand must be dependable and capable of withstanding use through countless cycles of assembly and disassembly.

Various arrangements are known for supporting small instruments, i.e. percussion, keyboards, etc., such that their playing surfaces can be easily reached by the performer. In particular, bracket arrangements for tom-toms, having several degrees of freedom, are useful particularly in multiple drum sets. Such arrangements are illustrated in U.S. Pat. Nos. 3,535,976, 4,543,446 and 4,796,508. These arrangement include a ball clamped into a socket, with a rod attached to and projecting from the ball to support a drum. Such devices offer both vertical and rotational freedom of movement.

Prior to the present invention, many percussion instruments were attached to stands by a threaded screw. FIG. 1, which structure will be discussed in greater detail below, illustrates this prior art arrangement. With this type of stand children have to balance the instrument onto a threaded screw and twist either the instrument or the stand to complete the assembly. Often, the result is an incomplete assembly; the instruments loose their balance and fall, the threads do not align and cross thread; the instruments are inadequately tightened and wobble, and/or the instruments are spun propeller-style with such force that the screws break. The need therefore exists for a musical instrument stand, particularly for use by young children, which overcomes the drawbacks of the prior art.

SUMMARY OF THE INVENTION

It is an object of the invention to provide a musical instrument stand which is easy to assemble and which holds an instrument firmly in place.

It is also the object of the invention to provide an assembly arrangement particularly suited for an educational environment and for small children.

The invention provides a bracket fitted onto a musical instrument and a stand for receiving the instrument and bracket. The bracket is preferably mounted on the center of gravity of the instrument. The bracket and stand assembly are provided with a mating coupling in the form of a spin-lock mechanism. During assembly the instrument and bracket are positioned on the stand, then rotated relative to one another to lock the assembly together. A tightening nut may also be provided to encure a secure fastening arrangement.

These and other objects and advantages of the invention will appear more fully from the following description made in conjunction with the accompanying drawings wherein like reference characters refer to the same or similar parts throughout the several views.

DESCRIPTION OF THE PREFERRED EMBODIMENT

Figure 1:
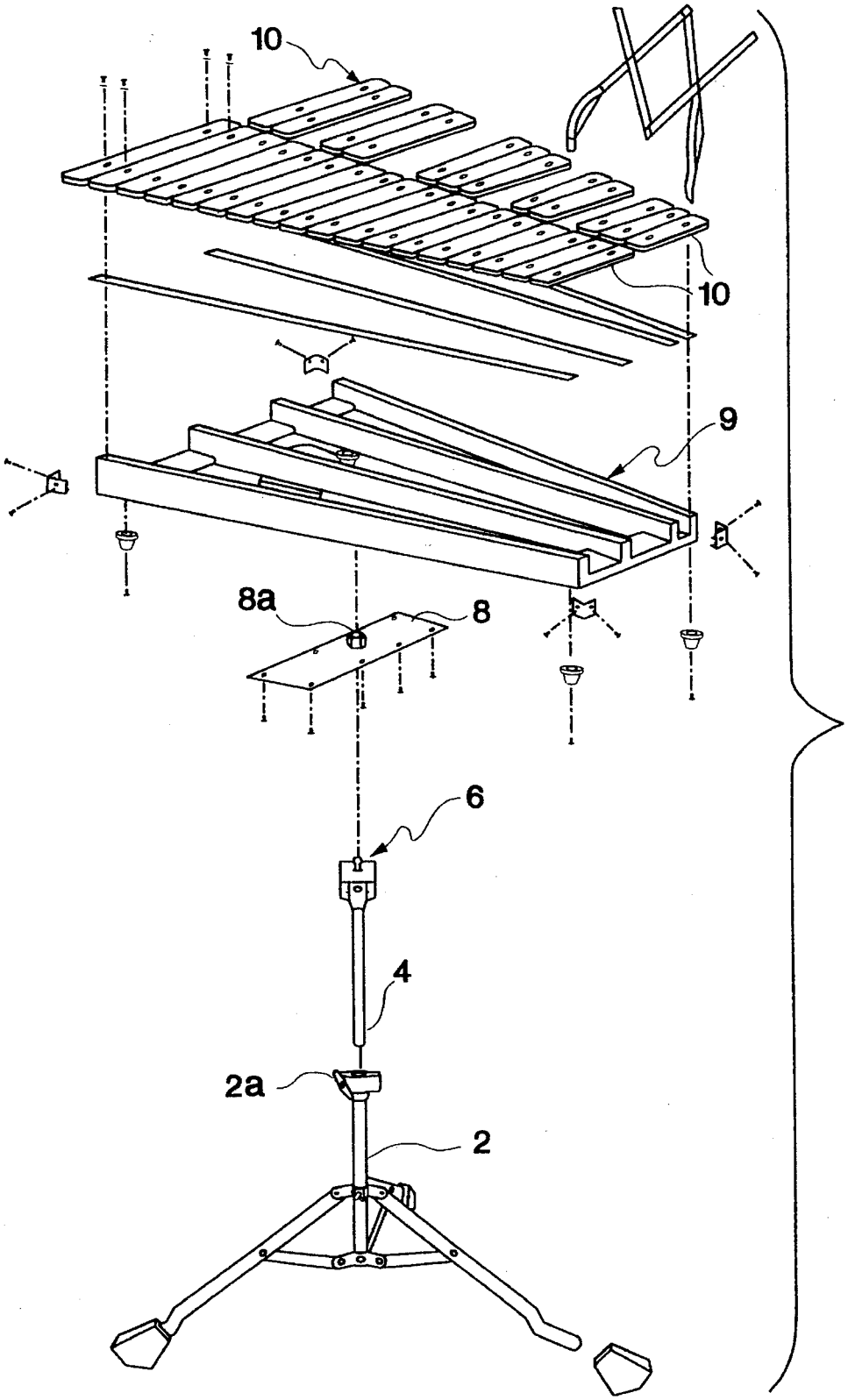
FIG.1 PRIOR ART
FIG. 1 is an exploded view of the prior art drum support utilizing a threaded screw.

FIG. 1 is an exploded view of the prior art drum support discussed above wherein a stand base 2, generally formed as a tripod, is provided with a telescopically adjustable rod 4 approximately ⅝ inch in diameter having a reduced threaded end portion 6. The adjustable rod 4 is secured at varying heights via the clamp 2*a*. For the conventional arrangement, a frame mounting plate 8 is formed with a nut 8*a* which threadingly receives the reduced threaded end portion 6 of the rod 4. The frame mounting plate 8 is designed for affixation to a musical instrument, i.e. percussion bars 10 mounted on frame member 9, in the form of a xylophone in FIG. 1.

Figure 2:
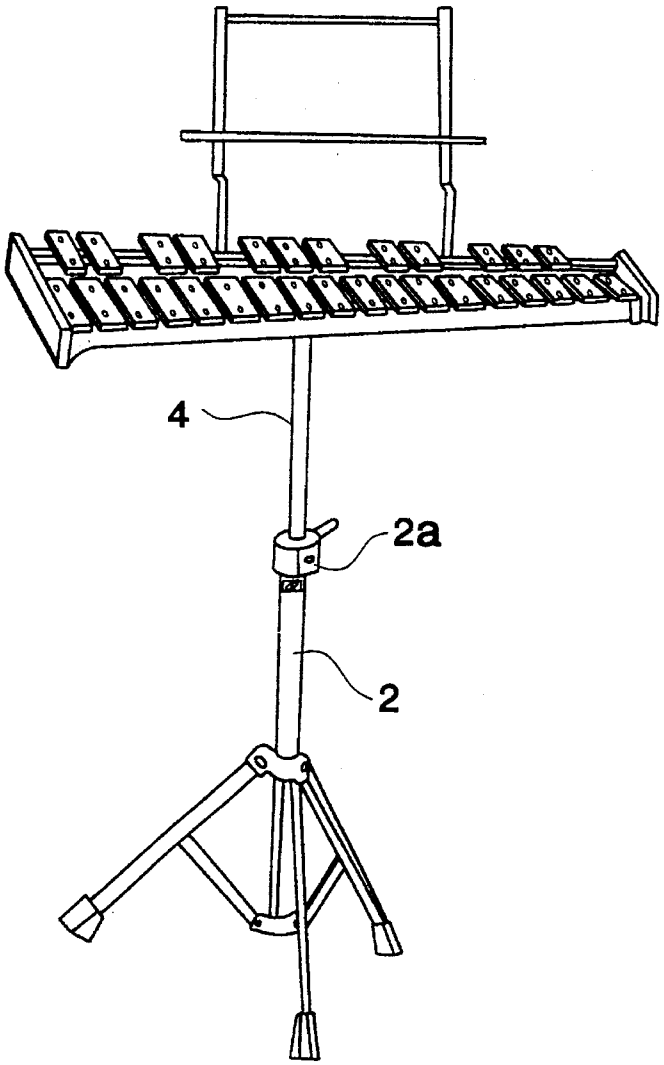
FIG. 2 is top left perspective view of the drum support of the invention.
Figure 3:
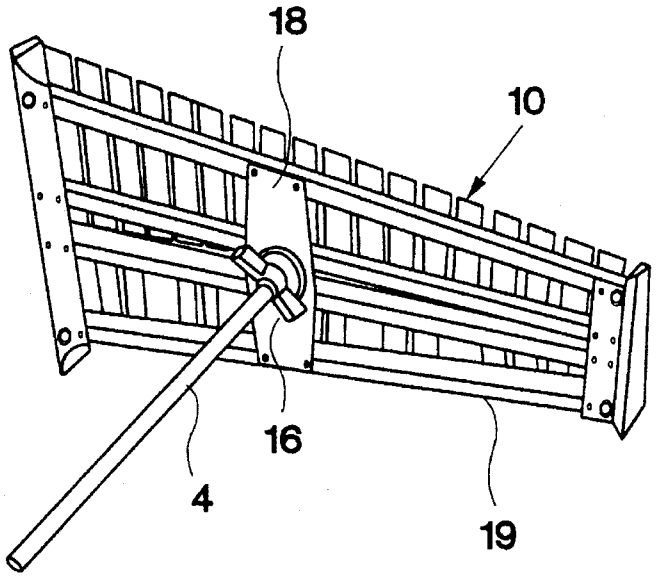
FIG. 3 is bottom right perspective view of part of the drum support of the invention.

With reference to FIGS. 2 and 3, the instrument stand of the invention similarly comprises a stand base 2 provided with a telescopically adjustable rod 4 of suitable dimensions whereby the desired height of the rod 4 is adjustably arranged via the clamp 2*a*. As opposed to the reduced threaded end portion 6 of the prior art arrangement, the adjustable rod 4 of the preferred embodiment is provided with a wing-type key member 16 which locks to the receiving unit 18 assembled to the frame 19. As with the conventional arrangement of FIG. 1, the embodiment of FIGS. 2 and 3 illustrate a percussion instrument in the form of a xylophone with percussion bars 10.

Figure 4:
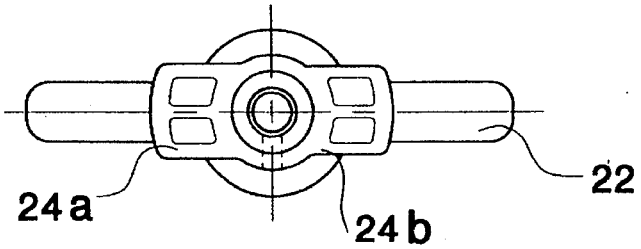
FIG. 4 is a top view of the wing-type key member of the invention.
Figure 5:
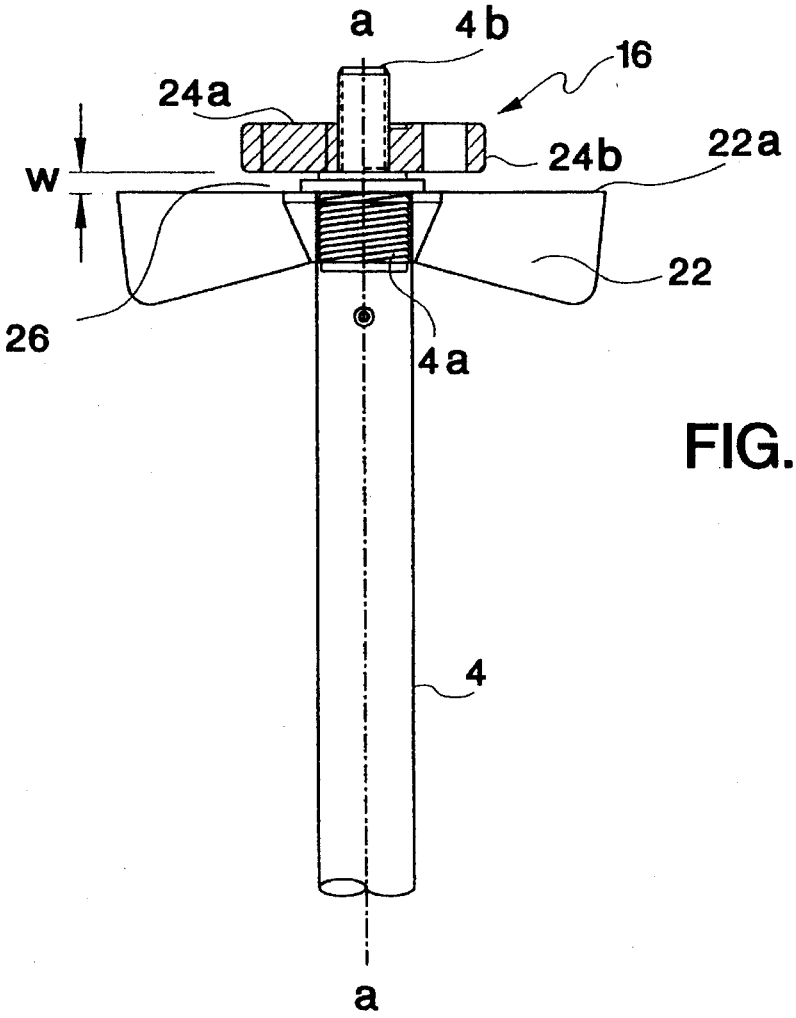
FIGS. 5 is an enlarged side view of the wing-type key member of the invention.

FIGS. 4 and 5 provide a top view and an enlarged view of the wing-type key assembly 16 nonrotatably provided on the rod 4. Specifically, the wing-type key assembly 16 is formed with a wing nut 22 threadingly provided on a threaded end portion 4*a* of the rod 4. The wing-type key assembly 16 further includes a reduced diameter shaft 4*b* having one end connected to the threaded end portion 4*a* so as to share a common longitudinal axis a—a. Connected to the reduced diameter shaft 4*b* are a pair of vertically oriented, oppositely positioned locking arms 24*a*, 24*b* extending at right angles relative to the axis a—a.

The locking arms 24*a*, 24*b* are positioned in an adjacent spaced relation to the upper surface 22*a* of the wing nut 22 so as to form the interspace 26 therebetween. The width W of the interspace is adapted to vary as the wing nut 22 is rotated about the threaded end portion 4*a*. It is noted a limiting plate may be provided between the wing nut 22 and the locking arms 24*a*, 24*b* to limit the minimum value of the width W.

Figure 6:
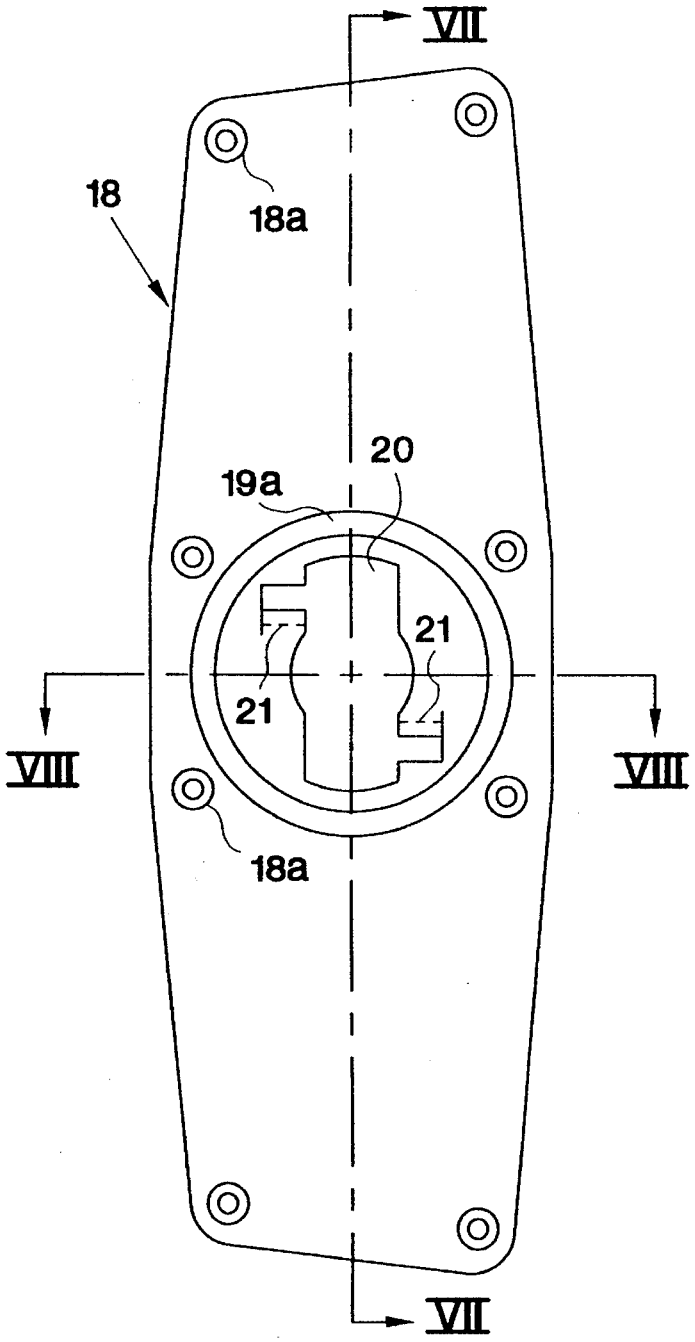
FIG. 6 is a top view of the receiving unit of the invention.
Figure 7:
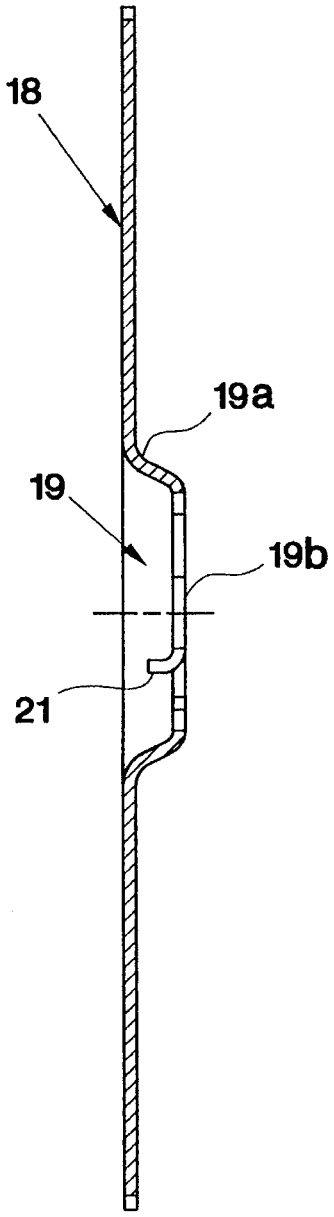
FIG. 7 is a cross sectional front view of the receiving unit of the invention taken along line VII—VII of FIG. 6.
Figure 8:
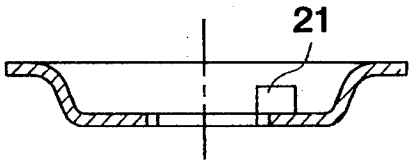
FIG. 8 is a cross sectional side view of the receiving unit of the invention taken along line VIII—VIII of FIG. 6.

FIGS. 6–8 illustrate various views of the receiving unit 18. The receiving unit 18 is formed as a frame mounting plate with a cylindrical recessed section 19 with a substantially cylindrical side wall 19*a* and a front wall 19*b*. As with the conventional arrangement shown in FIG. 1, the receiving unit 18 is adapted to be assembled to a frame for the musical instrument, for example by screw which pass through screw holes 18*a* to affix the unit 18 to the frame (see FIG. 1).

The cylindrical recessed section 19 comprises a central passage 20 generally formed as an elongated opening slightly larger in dimension than the reduced diameter shaft 4*b* and vertically oriented, oppositely positioned locking arms 24*a*, 24*b* such that the shaft 4*b* and the locking arms 24*a*, 24*b* are adapted to pass through the central passage 20. The passage of the wing-type locking device of rod 4 into the central passage 20 is limited by the wing nut 22 such that the upper surface 22*a* of the wing nut abuts against the front wall 19*b* of the receiving unit 18.

The recessed section 19 is further formed with delimiting tangs 21 which extend into the recess in a direction opposite the front wall 19*b*. The tangs 21 may be formed by crimping a portion of the front wall 19*b* if the receiving unit 18 is formed of steel, aluminum or other malleable material. It is noted however that the receiving unit 18 may also be formed of a polymer material such as plastic with suitable strength to ensure a stable locking device.

Figure 9A:
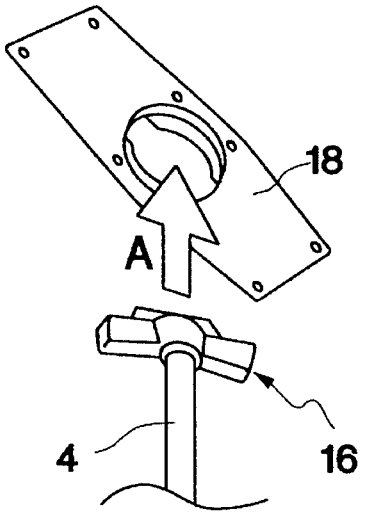
FIGS. 9*a*, 9*b* and 9*c* illustrate in sequence the operation of the locking mechanism of the invention.
Figure 9B:
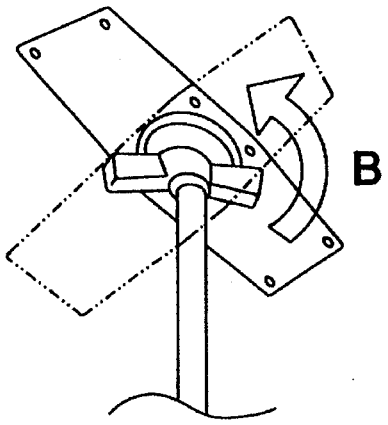
Figure 9C:
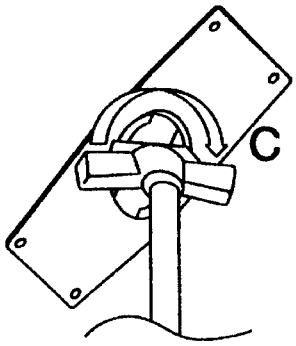

The operation of the locking mechanism of the invention will now be described with reference to FIGS. 9*a*, 9*b*, and 9*c*. It is noted that the frame and musical instrument have been omitted from the drawings for clarity. For assembly, the end of the rod 4 comprising the reduced diameter shaft 4*b* and vertically oriented, oppositely positioned locking arms 24*a*, 24*b* is inserted into the central passage 20 in the direction of arrow A and with the orientation illustrated in FIG. 9*a*. When the upper surface 22*a* of the wing nut 22 abuts the front wall 19*b* of the recessed section 19, the percussion assembly which is affixed to the receiving unit 18, and the rod 4 with associated stand base 2 are rotated relative to one another approximately 90 degrees to a locked position. Specifically, the receiving unit 18 is rotated in a counter-clockwise direction when viewed from the bottom as shown by arrow B in FIG. 9*b*. In the locked position, the locking arms 24*a*, 24*b* abut the delimiting tangs 21 to prevent further relative rotation of the receiving unit 18 and the rod 4. Next, the assembly is placed in the secured position by rotating the wing nut 22 in the clockwise direction shown by arrow C in FIG. 9*c*. The wing nut 22 moves relative to the rod 4 in the direction of the front wall 19*b* due to its threading engagement with the reduced threaded end 4*a*. Thus, the wing-type key member 16 is tightened by the wing nut 22 to clamp the receiving unit 18 to the rod 4 in an easily assembly and surely fastened manner.

Figure 10:
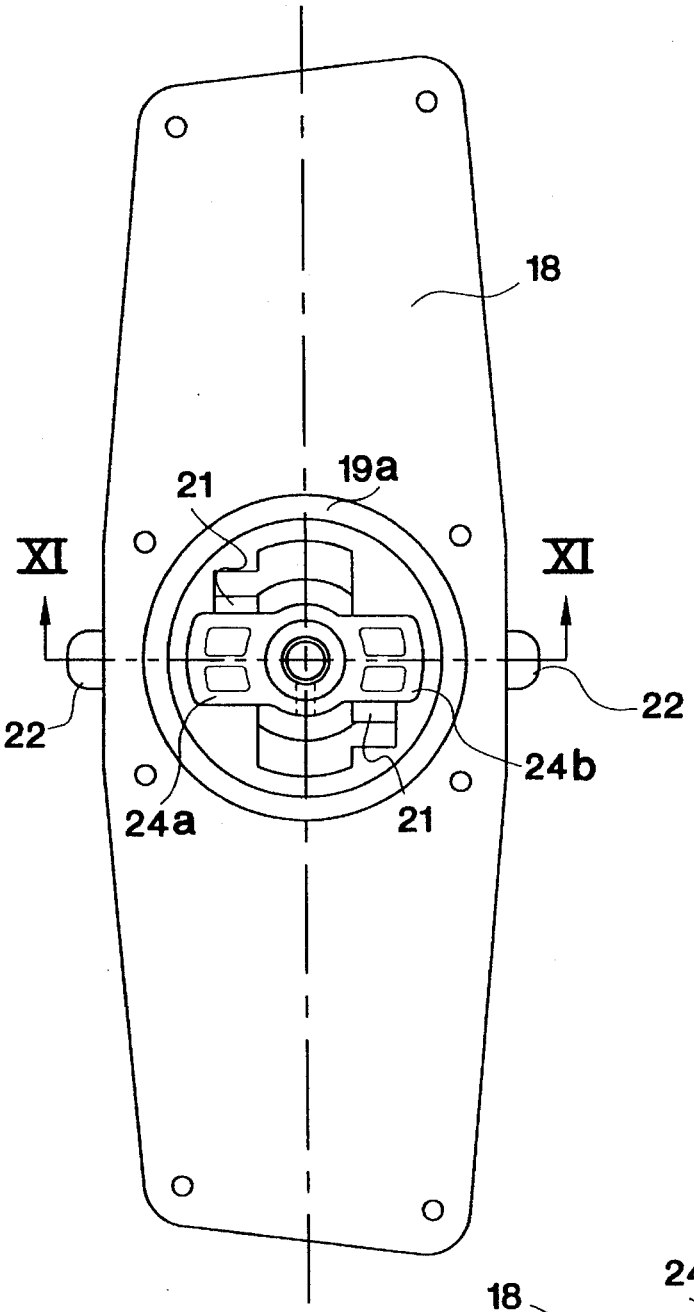
FIG. 10 is a partial bottom of the locking assembly illustrating the locked position whereby the locking arms 24*a*, 24*b* abut the delimiting tangs 21 after a 90 degree rotation of the rod 4 relative to the receiving section 18.
Figure 11:
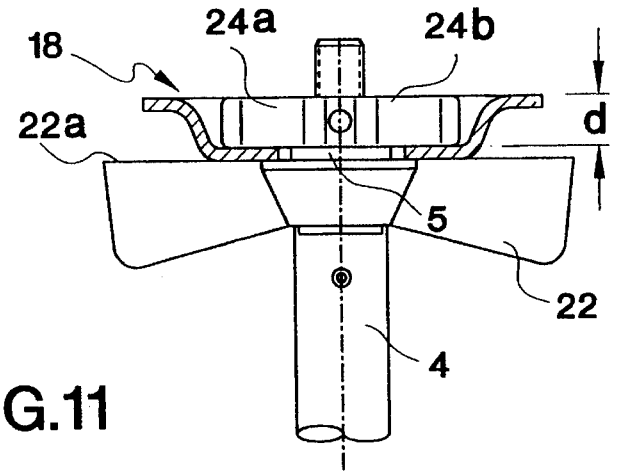
FIG. 11 is a cross sectional side view of the locking assembly taken along line XI—XI of FIG. 10.

FIG. 10 illustrates the locked position whereby the locking arms 24*a*, 24*b* abut the delimiting tangs 21 after a 90 degree rotation of the rod 4 relative to the receiving section 18. FIG. 11 illustrates the dimensional relationship of the locking arms 24*a*, 24*b* to the recessed section 19 wherein it is understood that the recessed section 19 if formed with a depth d substantially equal to the thickness of the locking arms 24*a*, 24*b* in the longitudinal direction of the rod 4. With this arrangement, the wing-type key member does not interfere with the arrangement or function of the musical instrument supported by the stand. In order to provide further stability in the locking assembly of the invention the rod 4 may be provided with a washer-like member 5 formed to be received in a close fitting manner in the central passage 20 when in the locked and secured positions.

While the invention has been shown and described with reference to specific embodiments, it is understood that various changes in form and detail may be made therein without departing from the spirit and scope of the invention. For example, while a 90 degrees rotation of the rod 4 relative to the receiving unit 18 was described above, it is understood that any degree of rotation is encompassed by the invention so long as the associated parts are locked together. Moreover, while two locking arms are described above, it is understood that any number may be provided to attain a suitable connection. The wing nut arrangement has also been set forth above by way of example only. It is understood that the wing nut 22 may be omitted entirely from the foregoing embodiment, or may comprise a clamping member rather than a threaded member to attain the secured position.

What is claimed is:

1. A support for a musical instrument comprising:

a base member for placement on a support surface, said base member comprising a support rod defining a longitudinal axis and a key member disposed proximate one end of said support rod;

an attachment plate adapted to be affixed to an instrument, said attachment comprising an aperture adapted to receive said key member; and locking means for securing said attachment plate to said base member at a locked position, wherein said base member is rotated relative to said attachment plate a predetermined angle from an unlocked position to said locked position.

2. The support according to claim 1, wherein said key member being adapted to pass into said aperture.

3. The support according to claim 2, wherein said attachment plate defines first and second opposed abutment surfaces.

4. The support according to claim 3, wherein said base member further comprises a tightening member.

5. The support according to claim 4, wherein said key member abuts said first abutment surface and said tightening member abuts said second abutment surface at said locked position.

6. The support according to claim 4, wherein said tightening member is threading disposed on said support rod to adjust a tightening force between said base member and said attachment plate.

7. The support according to claim 3, wherein said first abutment surface comprises at least one tang projecting therefrom.

8. The support according to claim 7, wherein said key member comprises at least one wing member adapted to abut said at least one tang at said locked position.

9. The support according to claim 1, wherein said attachment plate remains at a first position along said longitudinal axis during said relative rotation.

10. The support according to claim 1, wherein said key member is formed to congruously engage said aperture, said at least one wing member being adapted to pass through said aperture.

11. A support for a musical instrument comprising:

a base member for placement on a support surface, said base member comprising a support rod defining a longitudinal direction and a key member disposed proximate one end of said support rod, said key member having a plurality of projections extending radially from said rod;

an attachment plate adapted to be affixed to an instrument, said attachment comprising an aperture adapted to receive said key member; and locking means for securing said attachment plate to said base member at a locked position, wherein said base member is adapted for angular rotation relative to said attachment plate while maintaining a fixed relative position in said longitudinal direction with respect to said attachment plate to change said locking means from an unlocked position to said locked position.

12. The support according to claim 11, wherein said attachment plate comprises at least one tang adapted to abut at least one of said plurality of projections at said locked position.

13. The support according to claim 11, wherein said base member further comprises a tightening member.

14. The support according to claim 13, wherein said tightening member is threading disposed on said support rod to adjust a tightening force between said base member and said attachment plate.

15. The support according to claim 11, wherein said key member is formed to congruously engage said aperture, at least one of said plurality of projections being adapted to pass through said aperture.

* * * * *